US006594606B2

(12) United States Patent
Everitt

(10) Patent No.: US 6,594,606 B2
(45) Date of Patent: Jul. 15, 2003

(54) MATRIX ELEMENT VOLTAGE SENSING FOR PRECHARGE

(75) Inventor: James Everitt, Granite Bay, CA (US)

(73) Assignee: Clare Micronix Integrated Systems, Inc., Aliso Viejo, CA (US)

( * ) Notice: Subject to any disclaimer, the term of this patent is extended or adjusted under 35 U.S.C. 154(b) by 91 days.

(21) Appl. No.: 09/852,060

(22) Filed: May 9, 2001

(65) Prior Publication Data

US 2002/0169575 A1 Nov. 14, 2002

(51) Int. Cl.[7] ..... G06F 19/00; G09G 3/00

(52) U.S. Cl. ..... 702/107; 702/117; 702/125; 702/196; 345/55; 345/82; 345/205

(58) Field of Search ..... 702/64, 85, 104, 702/107, 116, 117, 125, 196; 326/37, 112, 113; 345/55, 82, 205–206

(56) References Cited

U.S. PATENT DOCUMENTS 5,844,368 A 12/1998 Okuda et al.
6,229,508 B1 * 5/2001 Kane ..... 345/82
6,366,116 B1 * 4/2002 Juang ..... 326/37

FOREIGN PATENT DOCUMENTS

GB 2371429 A * 7/2002

* cited by examiner

*Primary Examiner*—Bryan Bui
(74) *Attorney, Agent, or Firm*—Knobbe, Martens, Olson & Bear LLP

(57) ABSTRACT

A method and apparatus to calibrate an LED matrix display such that a driver will provide a proper precharge voltage to LED elements within the display during a scan period. A current is driven through a calibration element, and a voltage reflecting the steady-state element voltage is measured and stored as a calibration value. A processor controls whether to precharge during the calibration cycle, and determines when the calibration cycle is completed. During subsequent normal scans, a driver applies a voltage based on the stored calibration value to rapidly precharge parasitic capacitance associated with a display element to a proper value, and also drives a selected current through the device.

25 Claims, 8 Drawing Sheets

CALIBRATION MODE

NORMAL OPERATION - PRECHARGE

NORMAL OPERATION - DATA OUTPUT

MATRIX ELEMENT VOLTAGE SENSING FOR PRECHARGE

This application is related to commonly owned and concurrently filed provisional U.S. Patent Application Ser. No. 60/289,724 "PERIODIC ELEMENT VOLTAGE SENSING FOR PRECHARGE," the subject matter of which is hereby incorporated herein in its entirety by reference.

FIELD OF THE INVENTION

This invention generally relates to electrical drivers for a matrix of current driven devices, and more particularly to methods and apparatus for determining and providing a precharge for such devices.

BACKGROUND OF THE INVENTION

There is a great deal of interest in "flat panel" displays, particularly for small to midsized displays, such as may be used in laptop computers, cell phones, and personal digital assistants. Liquid crystal displays (LCDs) are a well-known example of such flat panel video displays, and employ a matrix of "pixels" which selectably block or transmit light. LCDs do not provide their own light; rather, the light is provided from an independent source. Moreover, LCDs are operated by an applied voltage, rather than by current. Luminescent displays are an alternative to LCD displays. Luminescent displays produce their own light, and hence do not require an independent light source. They typically include a matrix of elements which luminesce when excited by current flow. A common luminescent device for such displays is a light emitting diode (LED).

LED arrays produce their own light in response to current flowing through the individual elements of the array. The current flow may be induced by either a voltage source or a current source. A variety of different LED-like luminescent sources have been used for such displays. The embodiments described herein utilize organic electroluminescent materials in OLEDs (organic light emitting diodes), which include polymer OLEDs (PLEDs) and small-molecule OLEDs, each of which is distinguished by the molecular structure of their color and light producing material as well as by their manufacturing processes. Electrically, these devices look like diodes with forward "on" voltage drops ranging from 2 volts (V) to 20 V depending on the type of OLED material used, the OLED aging, the magnitude of current flowing through the device, temperature, and other parameters. Unlike LCDs, OLEDs are current driven devices; however, they may be similarly arranged in a 2 dimensional array (matrix) of elements to form a display.

OLED displays can be either passive-matrix or active-matrix. Active-matrix OLED displays use current control circuits integrated with the display itself, with one control circuit corresponding to each individual element on the substrate, to create high-resolution color graphics with a high refresh rate. Passive-matrix OLED displays are easier to build than active-matrix displays, because their current control circuitry is implemented external to the display. This allows the display manufacturing process to be significantly simplified.

FIG. 1A is an exploded view of a typical physical structure of such a passive-matrix display 100 of OLEDs. A layer 110 having a representative series of rows, such as parallel conductors 111–118, is disposed on one side of a sheet of light emitting polymer, or other emissive material, 120. A representative series of columns are shown as parallel transparent conductors 131–138, which are disposed on the other side of sheet 120, adjacent to a glass plate 140. FIG. 1B is a cross-section of the display 100, and shows a drive voltage V applied between a row 111 and a column 134. A portion of the sheet 120 disposed between the row 111 the column 134 forms an element 150 which behaves like an LED. The potential developed across this LED causes current flow, so the LED emits light 170. Since the emitted light 170 must pass through the column conductor 134, such column conductors are transparent. Most such transparent conductors have relatively high resistance compared with the row conductors 111–118, which may be formed from opaque materials, such as copper, having a low resistivity.

This structure results in a matrix of devices, one device formed at each point where a row overlies a column. There will generally be M×N devices in a matrix having M rows and N columns. Typical devices function like light emitting diodes (LEDs), which conduct current and luminesce when voltage of one polarity is imposed across them, and block current when voltage of the opposite polarity is applied. Exactly one device is common to both a particular row and a particular column, so to control these individual LED devices located at the matrix junctions it is useful to have two distinct driver circuits, one to drive the columns and one to drive the rows. It is conventional to sequentially scan the rows (conventionally connected to device cathodes) with a driver switch to a known voltage such as ground, and to provide another driver, which may be a current source, to drive the columns (which are conventionally connected to device anodes).

FIG. 2 represents such a conventional arrangement for driving a display having M rows and N columns. A column driver device 260 includes one column drive circuit (e.g. 262, 264, 266) for each column. The column driver circuit 264 shows some of the details which are typically provided in each column driver, including a current source 270 and a switch 272 which enables a column connection 274 to be connected to either the current source 270 to illuminate the selected diode, or to ground to turn off the selected diode. A scan circuit 250 includes representations of row driver switches (208, 218, 228, 238 and 248). A luminescent display 280 represents a display having M rows and N columns, though only five representative rows and three representative columns are drawn.

The rows of FIG. 2 are typically a series of parallel connection lines traversing the back of a polymer, organic or other luminescent sheet, and the columns are a second series of connection lines perpendicular to the rows and traversing the front of such sheet, as shown in FIG. 1A. Luminescent elements are established at each region where a row and a column overlie each other so as to form connections on either side of the element. FIG. 2 represents each element as including both an LED aspect (indicated by a diode schematic symbol) and a parasitic capacitor aspect (indicated by a capacitor symbol labeled "CP").

In operation, information is transferred to the matrix display by scanning each row in sequence. During each row scan period, each column connected to an element intended to emit light is also driven. For example, in FIG. 2 a row switch 228 grounds the row to which the cathodes of elements 222, 224 and 226 are connected during a scan of Row K. The column driver switch 272 connects the column connection 274 to the current source 270, such that the element 224 is provided with current. Each of the other columns 1 to N may also be providing current to the respective elements connected to Row K at this time, such as the elements 222 or 226. All current sources are typically at the same amplitude. OLED element light output is controlled by controlling the amount of time the current source for the particular column is on. When an OLED element has completed outputting light, its anode is pulled to ground to turn off the element. At the end of the scan period for Row K, the row switch 228 will typically disconnect Row K from ground and apply Vdd instead. Then, the scan of the next row will begin, with row switch 238 connecting the row to ground, and the appropriate column drivers supplying current to the desired elements, e.g. 232, 234 and/or 236.

Only one element (e.g. element 224) of a particular column (e.g. column J) is connected to each row (e.g. Row K), and hence only that element may be "exposed," or connected to both the particular column drive (264) and row drive (228) so as to conduct current and luminesce during the scan of that row. However, each of the other devices on that particular column (elements 204, 214, 234 and 244 as shown, but actually including typically 63 other devices) are connected by the driver for their respective row (208, 218, 238 and 248 respectively) to a voltage source, Vdd. Therefore, the parasitic capacitance of each of the devices of the column is effectively in parallel with, or added to, the capacitance of the element being driven. The combined parasitic capacitance of the column limits the slew rate of a current drive such as drive 270 of column J. Yet, rapid driving of the elements is necessary. All rows must be scanned many times per second to obtain a reasonable visual appearance, which permits very little time for conduction for each row. Low slew rates may cause large exposure errors for short exposure periods. Thus, for practical implementations of display drivers using the prior art scheme, the parasitic capacitance of the columns may be a severe limitation on drive accuracy.

A luminescent device matrix and drive system as shown in FIG. 2 is described, for example, in U.S. Pat. No. 5,844,368 (Okuda et al.). To mitigate the effects of parasitic capacitances, Okuda suggests, for example, resetting each element between scans by applying either ground or Vcc (10V) to both sides of each element at the end of each exposure period. To initiate scanning a row, Okuda suggests conventionally connecting all unscanned rows to Vcc, and grounding the scanned row. An element being driven by a selected column line is therefore provided current from the parasitic capacitance of each element of the column line which is attached to an unscanned row. The Okuda patent does not reveal any means to establish the correct voltage for a selected element at the moment of turn-on. In many applications the voltage required for display elements at a given current will vary as a function of display manufacturing variations, display aging and ambient temperature, and Okuda also fails to provide any means to compensate for such variation.

The large parasitic capacitance of OLEDs in a matrix can cause substantial errors in the actual OLED current conducted in response to a controlled current drive. Accordingly, some form of precharge scheme is useful to bring the OLED elements of a matrix rapidly up to the voltage at which they will drive the intended current at the beginning of the row scan cycle. Moreover, since the voltage for an OLED varies substantially with temperature, process, and display aging, the light output of the display can be more accurately controlled if the "on" voltage of the OLEDs is monitored or calibrated. Accordingly, what is needed in this industry is a means to determine and apply the correct voltage at the beginning of scans of current-driven devices in an array.

SUMMARY OF THE INVENTION

In response to the above-described need, a method and apparatus is provided for accurately monitoring or calibrating the display conduction voltages. The OLED response is so slow that the individual OLEDs may not be on long enough during a scan period to settle to their steady state voltage, making it difficult to monitor OLED voltages during an ordinary scan period. Accordingly, calibration may be performed during a calibration cycle.

In one aspect, the invention is a method for determining a precharge voltage for current-driven devices in a matrix. The method includes driving a selected current through a target device in the matrix, and determining an appropriate calibration time to measure a calibration voltage produced by the target device conducting the selected current. The appropriate calibration time is when the voltage produced in the target device by the selected current has reached steady state, and it may be determined by any of a number of different procedures, as elaborated in the detailed description. A voltage of the display is sampled at the calibration time, and a digital value created to represent the voltage is stored for later use during normal operation.

In another aspect, the invention is an apparatus for driving a current in an element of a display device. The apparatus includes two drivers, one for generating the current for the element, and another for connecting the other side of the element to a known voltage to accept the current. The apparatus also includes a sensing circuit to sense a voltage produced by the display device conducting a known current, and a precharge circuit configured to output a precharge voltage to the element based upon the sensed voltage.

In yet another aspect, the present invention is a method of calibrating a display device having at least one electroluminescent element and a display driver. The method includes applying a current to the element from a start time, and continuing the current for a predetermined period of time. At the end of the predetermined period, a display device voltage which reflects the element voltage is measured. After one or more measurement periods, a representation of the measured voltage is stored as a calibration value for later use during a non-calibration mode of the display device.

During normal operation the stored OLED voltage (Vcm) may be converted to an analog voltage by a digital to analog converter (DAC) and provided to each element during a column precharge period at the beginning of each scan cycle. After the precharge period, the channel output currents may be delivered to the channels in a conventional manner. At the end of the scan cycle, the individual columns may be shorted to ground in a conventional manner to terminate the element's exposure time.

DETAILED DESCRIPTION

The following detailed description is directed to certain specific embodiments of the invention. The embodiments described overcome obstacles to accurate generation a desired amount of light output from an LED display, particularly in view of the relatively high parasitic capacitances, and forward voltages which vary with time and temperature, which are quite pronounced in devices like OLEDs. However, the invention can be embodied in a multitude of different ways. The invention is more general than the embodiments which are explicitly described, and is not limited by the specific embodiments but rather is defined by the appended claims. In particular, the skilled person will understand that the invention is applicable to any matrix of current-driven devices to enhance the accuracy of the delivered current.

The charge from the current source which flows into the parasitic capacitance is subtracted from the charge intended for the driven OLED, thus reducing its actual LED current, and hence its brightness. This loss is significant for displays of practical size operated at practical scan rates.

Normal Display Drive

Figure 1B:
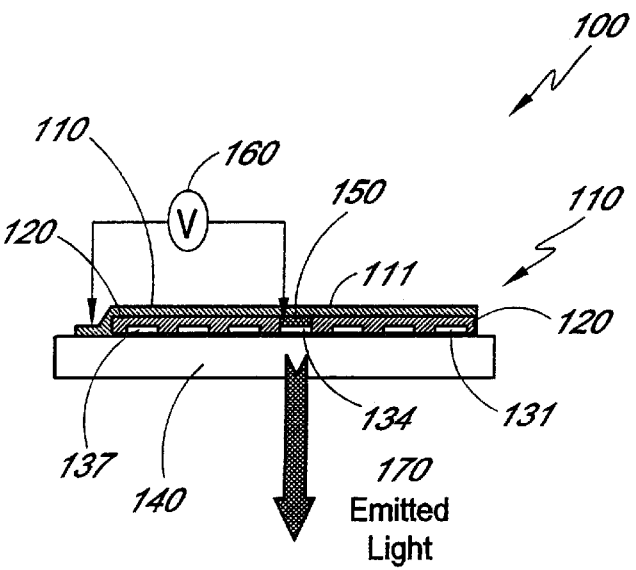
FIG. 1B is a side elevation view of the OLED display of FIG. 1A.
Figure 1A:
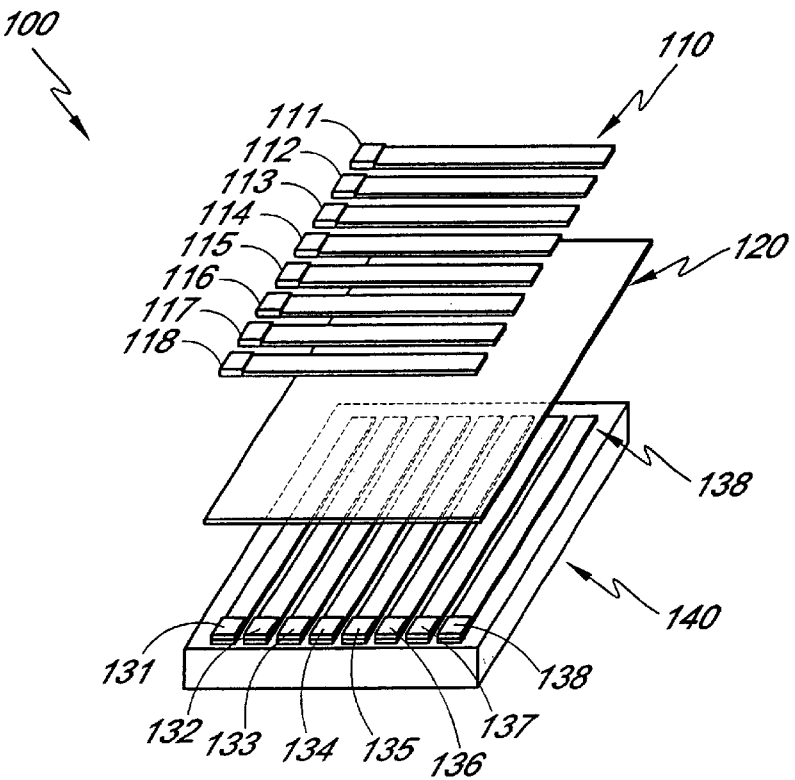
FIG. 1A is a simplified exploded perspective view of an OLED display.
Figure 2:
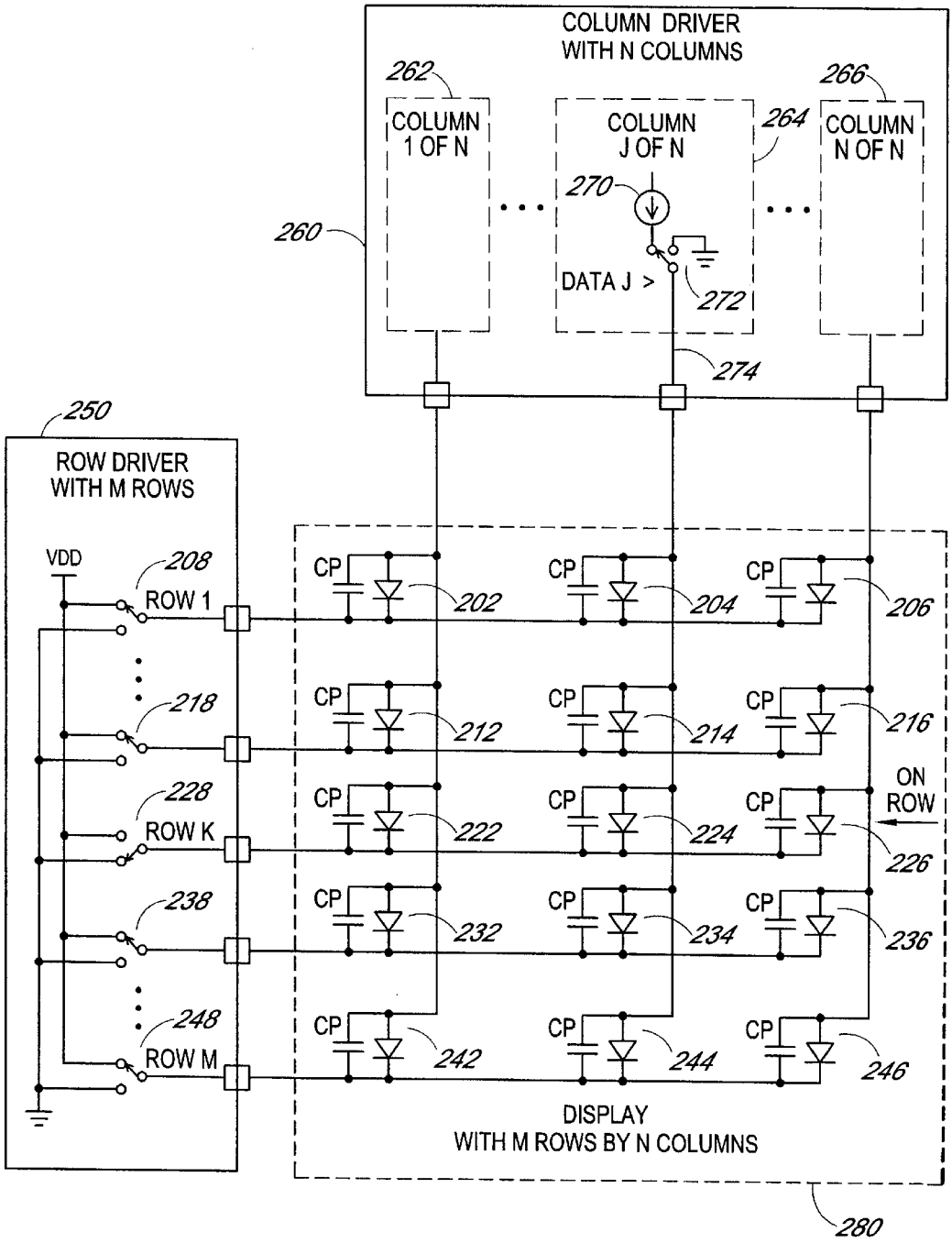
FIG. 2 (PRIOR ART)
FIG. 2 is a simplified schematic diagram of a display, column driver and row driver as known in the prior art.

Considerations for a passive current-device matrix and drive system, as used with embodiments described herein, are described with further reference to FIG. 2. Current sources such as the current source 270 are typically used to drive a predetermined current through a selected pixel element such as the element 224. However, the applied current will not flow through an OLED element until the parasitic capacitance is first charged. When the row switch 237 is connected to ground to scan Row K, the entire column connection 274 must reach a requisite voltage to drive the desired current in element 224. That voltage may be, for example, about 6.5V, and is a value which varies as a function of current, temperature, and time. The voltage on the column connection 274 will move from a starting value toward a steady-state value, but not faster than the current source 270 can charge the combined capacitance of all of the parasitic capacitances of the elements connected to the column connection 274. An exemplary display has 64 rows and requires 150 scans per second in order to create a display which appears smooth. This limits the row scan period to 1/(150*64) seconds, or about 100 microseconds ($\mu$S). The row scan time is further broken up into 63 segments to allow for controlling the light output from the OLED element over a range of 0 to 63. Therefore an OLED element could be on for as little as 100 $\mu$S/63 or about 1.6 $\mu$S. Parasitic column capacitance is about 1.2 nanofarads (nF). Desired OLED current is 100 $\mu$A and OLED steady state voltage is about 5 volts (V) at this current. The ability of the current source to bring the OLED element to the proper operating voltage is determined by the formula for charging a capacitor which states capacitance (C) times voltage change (dV) equals charging current (I) times charging time (dT) or $C \times dV = I \times dT$. A 100 $\mu$A current source charging a 1.6 nF capacitance for 1.6 $\mu$S can only slew the voltage 100 $\mu$A×1.6 $\mu$S/1.6 nF=0.1 V. The result is that the current through the LED (as opposed to the current charging the parasitic capacitance) will rise very slowly, and may not achieve the target current even by the end of the scan period. In the example given, if driving from ground the 0.1 V change in OLED voltage would not begin to approach the 5 V required for proper conduction.

Since the current source 270, alone, will be unable to bring an OLED from zero volts to operating voltage during the entire scan period in the circumstance described above, a distinct "precharge" period may be implemented during which the voltage on each device is driven to a precharge voltage value Vpr. Vpr is ideally the voltage which causes the OLED to begin immediately at the voltage which it would develop at equilibrium when conducting the selected current. The precharge is preferably provided at a relatively low impedance in order to minimize the time needed to achieve Vpr.

Calibration to Select a Precharge Voltage

Figure 3:
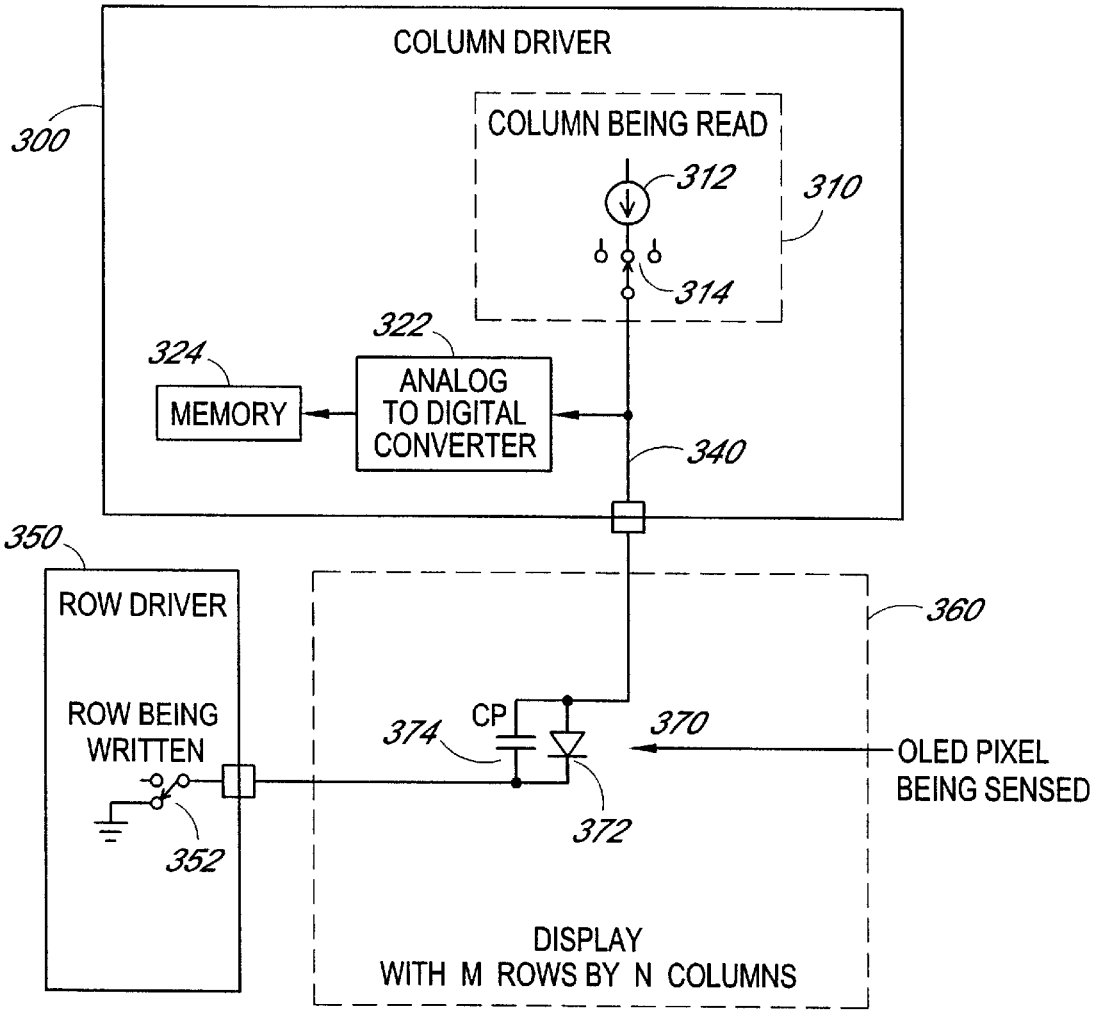
FIG. 3 is a schematic representation of elements for calibrating a display.

A device conduction voltage, Vcm, may be measured and used as a calibration value to select a precharge voltage. For example, in one embodiment as shown in FIG. 3, Vcm is the voltage of a column connection 340, measured while an LED 372 is conducting a current from a current source 312, through a row driver switch 352 of a row driver 350, to ground. Vcm reflects the voltage actually induced across a display element 370 due to the current it is conducting, after all of the parasitic capacitances connected to the column connection 340 are fully charged to their steady-state value. The parasitic capacitances include that of a parasitic capacitor 374, which is an aspect of the display element 370. For design convenience, Vcm may also include other voltage drops in the system, such as those caused by row and column impedances and those caused by the impedance of the row driver switch 352.

Only element 370 of a display 360 is shown in FIG. 3 as being sampled for calibration. However, the number and display location of the elements for which Vcm is sampled may be defined in any convenient way, based on engineering considerations. For example, Vpr may be determined from a device conduction voltage Vcm for a selected element 370 within a display 360, or it may be averaged from Vcm for a plurality of such elements. It is in principle possible to determine a Vcm for each element of a matrix independently.

Vcm may be measured as the voltage at the column connection 340 in a driver 300, and thus reflects not only the voltage of the LED aspect 372 of the element 370, but also the voltage created by the current from the current source 312 flowing through the column connection, the row connection, and the row driver 352. The current is maintained for a period of time, T(settle), which permits steady state to be reached for the voltage on the parasitic capacitor 374. At steady state, the voltage is not varying significantly, and as a result current is not flowing into the parasitic capacitor 374 or any other parasitic capacitance connected to the column connection 340. At steady state, therefore, all of the current from the current source 312 is flowing through the LED 372 aspect of the element 370, which accordingly has developed its steady state "on" voltage for that current. At this time, the voltage of column connection 340 may be measured by an analog to digital converter (ADC) 322, and a value representing the voltage may be stored in a memory 324.

T(settle) may be determined in any of several ways by a processor (not shown) or another device which controls the drivers. For example, a worst-case settling time may be determined based upon the predicted column parasitic capacitance and the selected current, modified to allow for the forward diode current of the LED. Equations which may be used to calculate this value are well known in the art, and may be based upon characteristics of the particular type of display elements (e.g. OLEDs) being measured. Alternatively, the settle time may be empirically derived from measurements of actual device settling times, and stored, for example, in nonvolatile memory. For presently known OLED display devices, T(settle) is expected to fall within the range of 100 $\mu$S to 10 mS. A measurement may be made at the end of T(settle), and may be used thereafter at least until the device conduction voltage Vcm changes significantly. Vcm may change, for example, due to changes in the selected current, temperature, or age of the device.

Alternatively, T(settle) may be determined by comparing successive measurements separated by a measurement time, Tm, which may be fixed or variable. By comparing the measurements to each other, steady state may be discerned by the closeness of successive values. Many algorithms may be used to determine when steady state has been achieved. For example, each successive measurement may simply be compared against the previous one, and the termination time of the measurement may be indicated when a difference less than a preselected threshold of $\Delta V$ is obtained. The preselected threshold $\Delta V$ may be set, for example, to about 0.5% of the value of the measurement. Many more elaborate techniques may also be used, such as requiring three measurements to all be within a specified range $\Delta V$, and/or digitally filtering the successive measurements to reduce sensitivity to noise. A period between measurement samples, Tm, may be selected to be either fixed or variable, and $\Delta V$ may be adjusted proportionally to Tm in order to represent a similar rate of change of voltage. A fixed Tm may be selected, for example, from within the range of 5 $\mu$S to 200 $\mu$S, depending upon design goals and implementation details. Tm may also be varied, for example starting with a long Tm and decreasing the Tm between successive measurement samples as steady state is approached. As a practical matter, T(settle) may be deemed to have been reached once the rate of change of the voltage falls below a selected threshold, and the last measurement may then be stored as Vcm.

The period T(settle) may be reduced by precharging the column of the measured display element. For example, an approximate value for Vcm may already be known from previous calibrations of the particular display/driver combination. Such an approximate Vcm may be provided in nonvolatile memory from factory tests, or may be estimated from known parameters of the display. T(settle) will be reduced as long as precharging moves the column voltage closer to the final Vcm than it would otherwise have been. Moreover, due to the nonlinear conductance of diodes including OLEDs, T(settle) may also be reduced by precharging the column voltage for the sensing element such that the column voltage exceeds the final Vcm measured. Repetitive measurements permit a system to recognize when T(settle) has been reached, so that precharging to reduce T(settle) by a significant but unknown amount can shorten the calibration period.

Finally, note is made that calibration may be performed while other elements are driven. This may be done to determine the effective impedance of columns or rows. It may also be done to permit calibration during otherwise normal operation. If calibration is performed during ordinary operation, filtering and averaging of the measured values may be required to avoid obtaining measurements which are adversely affected by noise, or by variations in currents in other parts of the display.

Applying Precharge in Normal Operation

Figure 4A:
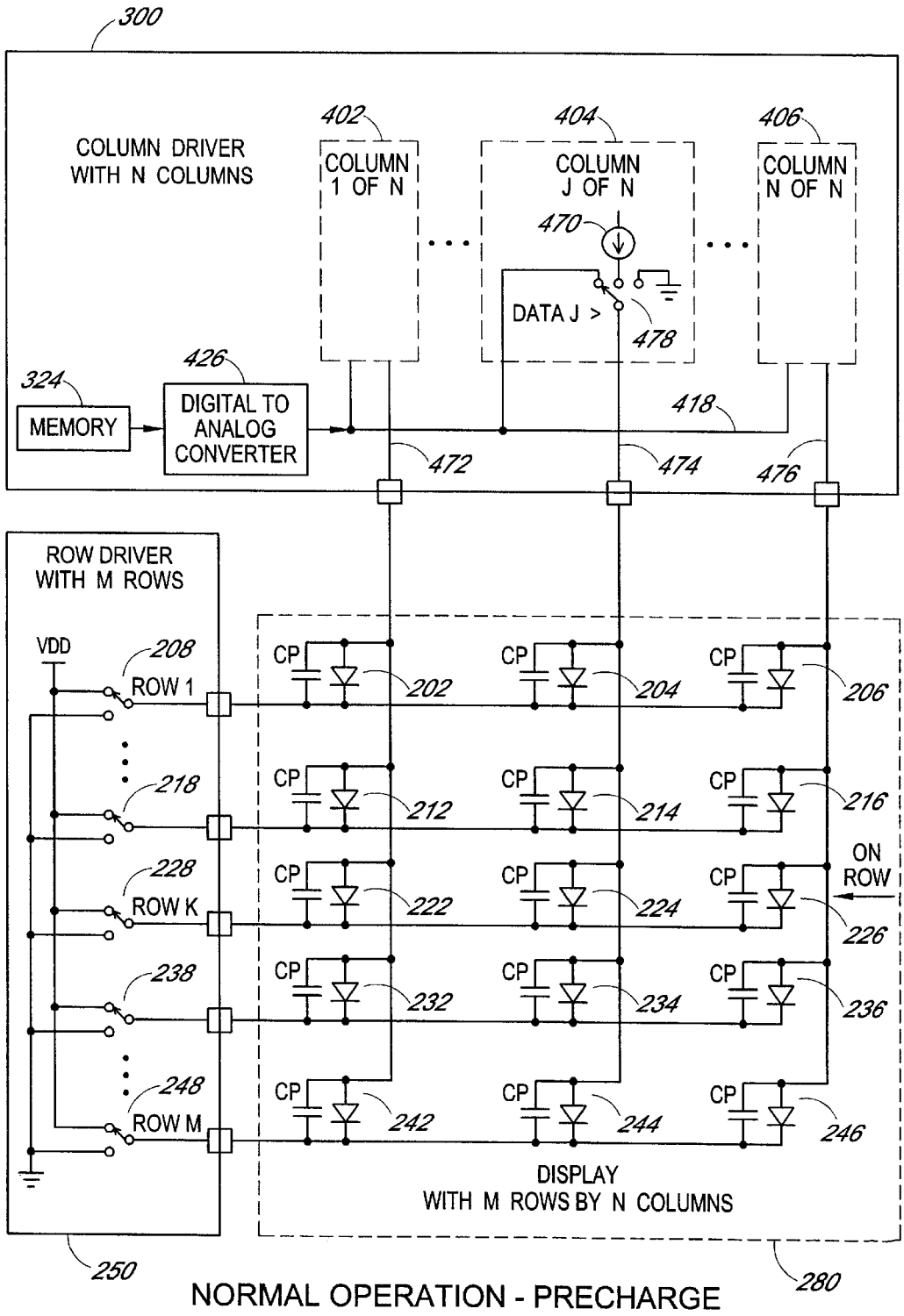
FIG. 4A is a simplified schematic diagram of a display and drivers during precharge.
Figure 4B:
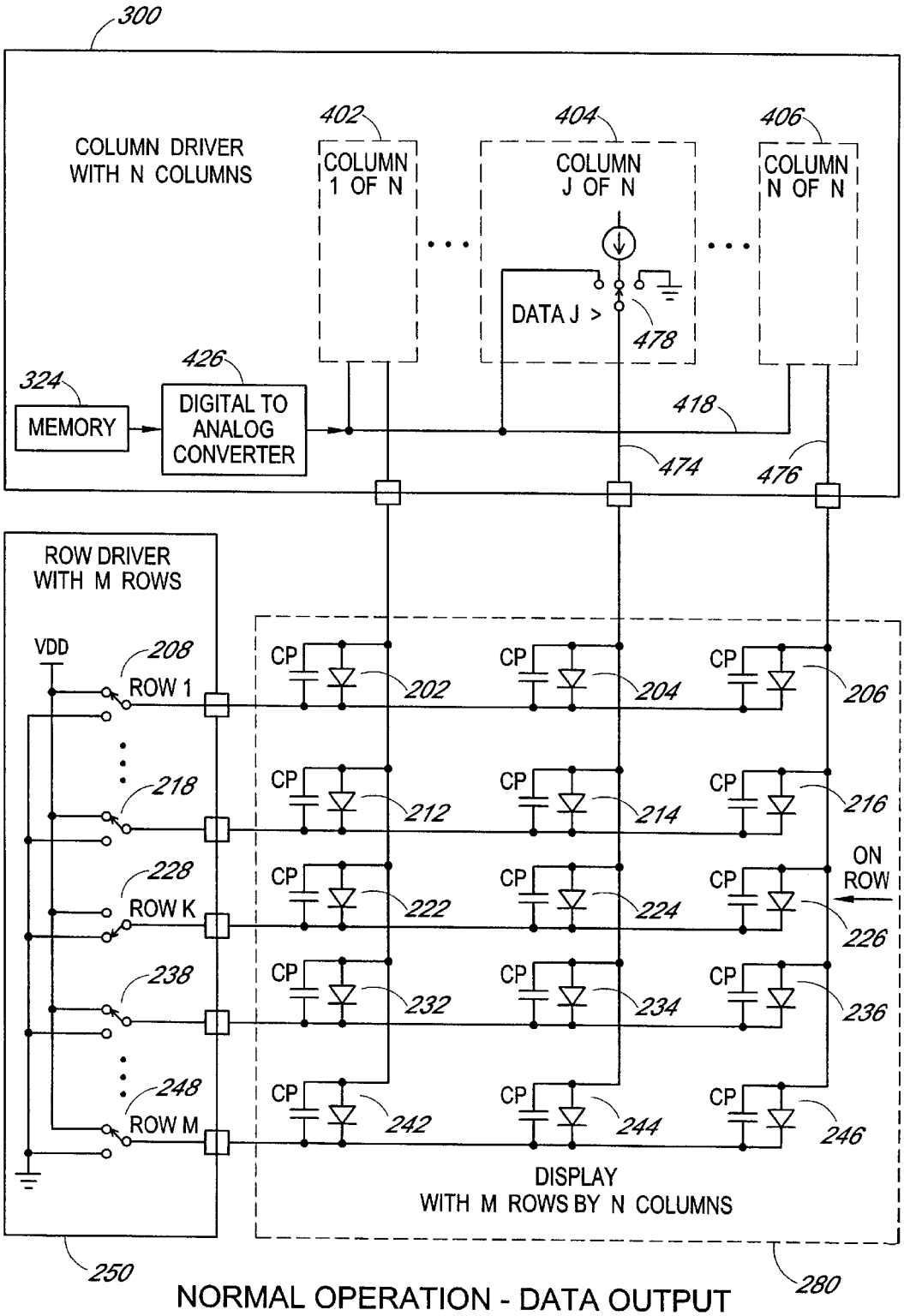
FIG. 4B is the diagram of FIG. 4A, modified for the exposure period.

FIG. 4A is a schematic representation of a typical circuit during precharge, while FIG. 4B is the same schematic representation, except that appropriate switches (228 and 478) are in position for exposure, or conduction, of the selected elements. Both figures are referenced in this discussion.

The stored value of the device conduction voltage Vcm may be used as a basis for precharging the parasitic capacitance of columns to a precharge voltage Vpr at the beginning of exposures, as shown in FIG. 4A. In particular, a DAC 426 outputs Vpr as derived from the value Vcm previously stored in the memory 324. Vpr may be selected to match Vcm as closely as possible. It may also be adjusted to compensate for known or expected differences between the Vcm of the calibration element, e.g. 370, and an element presently being driven. For example, some elements will have more column and/or row resistance to the drivers than other elements. The different voltage losses due to the connection resistances may be measured or predicted, and based upon the selected current a Vpr difference may readily be calculated. The Vpr used may then be adjusted for such calculated difference.

At the beginning of a scan period for the representative Row K 420, a row switch 228 connects the Row K 420 to a high voltage to ensure that the selected row of OLED elements is not conducting during precharge. In a column J driver 404, a switch 478 connects a column J connection 474 to a DAC 426 output Vpr 418. Thus, during a precharge period at the beginning of the scan, the column J connection 474 is driven from the relatively low impedance source of the DAC 426. Each of the parasitic capacitors (CPs) of all of the elements connected to column J (e.g. the CPs of elements 204, 214, 224, 234, and 244) are thus charged quickly to Vpr, which is based on the measured voltage Vcm. If elements 222 or 226, connected to the column connections 472 and 476 respectively, are to conduct during the scan period, then similar switching will be provided within their respective column drivers 402 and 406.

The duration selected for the precharge period depends upon several factors. Each selected column has a parasitic capacitance and a distributed resistance which will affect the time required to achieve the full voltage on the driven element. Moreover, the drivers have certain impedances which are common to a varying number of active elements, and their effective impedance will therefore vary accordingly. For example, if all of the elements in a row are selected, then the load seen by the DAC 426 during precharge may include N parallel column loads. To avoid the impedance of the DAC 426 from significantly contributing to the precharge duration, the DAC 426 may include a substantial capacitor. A typical 64 row, 96 column device might have a column resistance of about 1 K ohms, and a parasitic capacitance of about 1600 pF. The DAC capacitor value is preferably on the order of 100 or more times the parasitic capacitance of all of the columns, in this example 100*96*1600 pF, or about 15 $\mu$F. In this case, 18 $\mu$F to 100 $\mu$F or more is appropriate. If the column driver is an integrated circuit, then such a large capacitor is preferably located external to the driver. Thus, the DAC source impedance becomes negligible, and the precharge time constant ($\tau$) in this case will be about 1.6 $\mu$S, due primarily to the column resistance and the parasitic capacitance. Generally, given a precharge time constant $\tau$, it is preferred to continue precharge for about three times the length of $\tau$, or in the present example about 5 $\mu$S.

An alternative means to minimize the DAC impedance effect on the precharge time is to provide a Vpr buffer for each column or each group of columns, so that each column has a relatively fixed impedance of precharge. This "distributed Vpr buffer" embodiment also permits adjustment of the precharge level for each column or group of columns for which a precharge driver is provided. By providing a predictable precharge voltage response, the distributed Vpr buffer approach also permits directing exposure during precharge. In this embodiment, exposure times which extend into the precharge period may need to be adjusted for the nonlinearity of the conduction during this time, which varies depending on the row being scanned due to the varying column impedance which is "seen" by each row. In accordance with this alternative, the row switch 228 of FIG. 4A may connect Row K to ground during part of the precharge period.

At the end of the precharge period, the selected elements are "exposed," or connected for current conduction, as shown in FIG. 4B. The row switch 228 of the row being exposed (row K) is switched to ground to begin the exposure period. At the same time, column drive switches (e.g. 478 in column J driver 404) of the selected elements (e.g. element 224) may switch each selected column connection (e.g. 474) to the column current sources (e.g. current source 470 in column J driver 404) for the exposure period for the selected elements (e.g. 224).

The skilled person will, of course, appreciate that any or all of the elements (e.g. 202, 204, 206; 212, 214, 216; 222, 224, 226; 232, 234, 236; or 242, 244, 246) of any scanned row may generally be selected during the scan of that row.

Each individual element may generally be turned off at a different time during the scan of the element's row, permitting time-based control of the output of each element. It should be noted that in the case of "off" OLED elements, the column precharge may be skipped entirely to save power. At the end of an exposure time for a particular element (e.g. 224), the column connection (e.g. 474) will generally be disconnected from the current source (e.g. 470) and reconnected to ground or other low voltage, so as to rapidly terminate conduction by the element. At the end of the exposure time for the last element remaining "on" in a scanned row, the row switch (e.g. 228) in the scan circuit row driver 250 may connect the row connection (e.g. 420) to a supply, such as Vdd, to preclude further conduction by the elements. For elements which are conducting for the maximum time of the scan, this termination step at the end of the scan period obviates a need for a separate "grounding" action to terminate their conduction. In that case the column is left fully charged, thus reducing the current load on the precharge supply for the scan of the next row. These interactions will be further described below with respect to FIG. 5B.

Timing Diagrams—Calibration

Figure 5A:
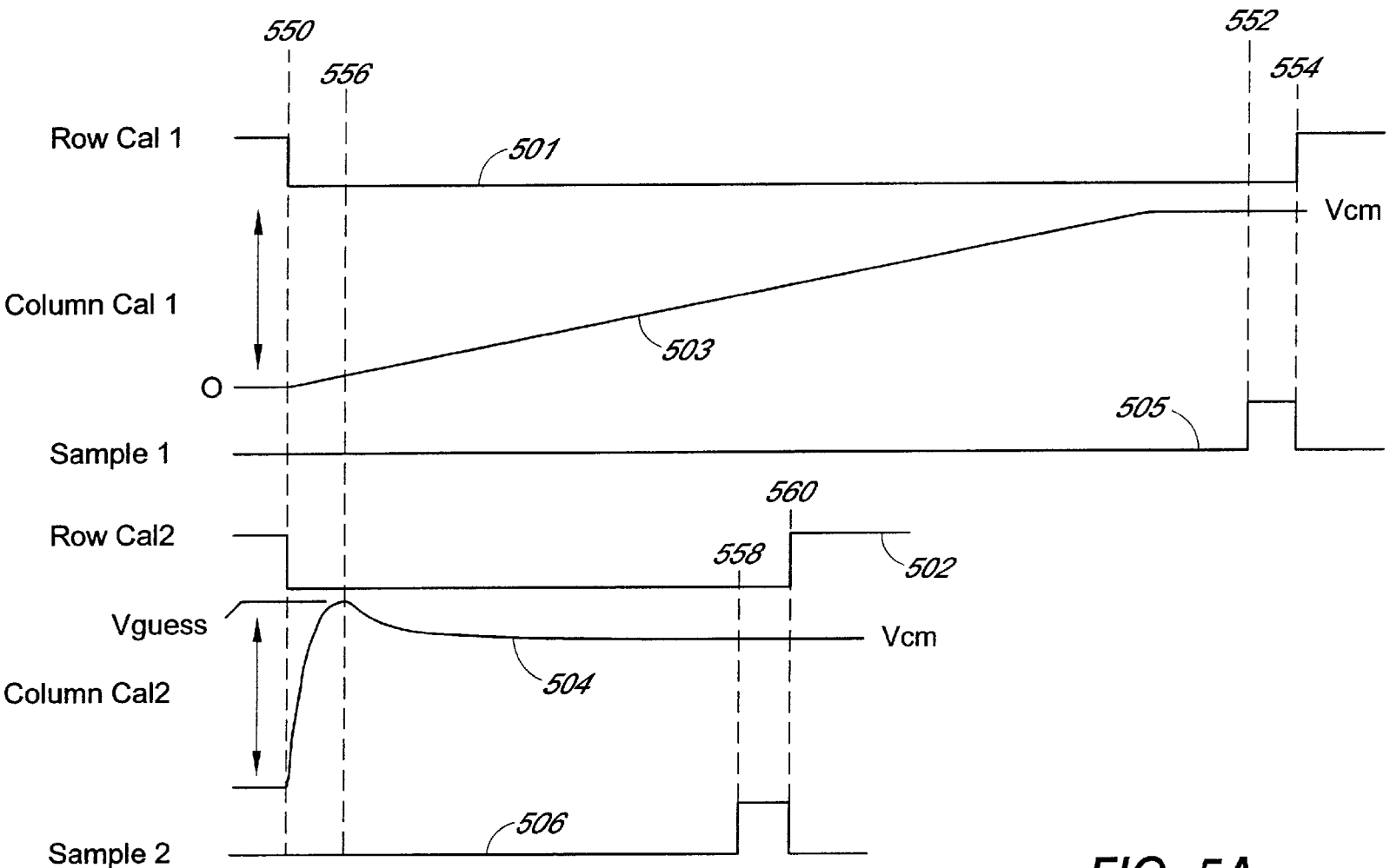
FIG. 5A is a waveform and timing diagram showing calibration.

FIG. 5A shows the approximate voltages, versus time, on row, column and ADC sample control lines, for two exemplary calibration cycles. The first calibration cycle is represented by a trace 501 of a first row line Row Cal 1, a trace 503 of a first column line Column Cal 1, and a trace 505 of a first ADC sample control line Sample 1. The second calibration cycle is similarly represented by traces 502, 504 and 506 which reflect, respectively, a second row line Row Cal 2, a second column line Column Cal 2, and a second ADC control line Sample 2.

The duration of a calibration period should exceed a settling time T(settle), and may be readily selected by the skilled person as described above, either analytically based upon the characteristics of the display device, or by empirical measurement, or by repetitive measurements which are compared for constancy. The first example calibration cycle may be started at a time 550, at which time the row (trace 501) is grounded while the column (trace 503) is driven by its current source from its original voltage of zero. As can be seen, it may take a relatively long time, possibly many ordinary scan periods, before the column voltage settles after a time T(settle) and reaches its steady state value. This is shown to occur just before a time 552. When the voltage on the ADC control line (trace 505) is raised between the time 552 and a time 554, a sample is taken of the column voltage (trace 501) for the ADC. This measurement has been taken after the column voltage (trace 503) reached steady state, and accordingly is stored as the calibration value Vcm. The measurement and storage of this final value of Vcm completes the calibration period. The settling times T(settle) for this approach will typically range between 0.1 mS and 10 mS.

However, it is not necessary to start from zero voltage across the element when applying the selected current. Rather, the column may be precharged to a voltage closer to the steady-state value, which will reduce the time T(settle) required to reach steady state. Moreover, for a given difference between the steady-state voltage Vcm and the calibration precharge voltage Vguess, T(settle) will be shortest when Vguess exceeds Vcm, because the impedance of the OLED is lower when the voltage is higher. The second exemplary calibration cycle, represented in FIG. 5A by traces 502, 504 and 506 (the second row, column and control line respectively), demonstrates this circumstance. At the time 550 a precharge voltage Vguess is applied to the column (trace 504), as discussed above with respect to FIG. 4, causing the column voltage to rise fairly rapidly to Vguess. At a time 556, the precharge voltage is released, and the selected current may be deemed to start. However, due to the low impedance of the precharge supply compared to the current source, it is unimportant whether the current source is in fact active during the precharge period between the times 550 and 556. As shown, there will generally be a difference between the calibration precharge voltage Vguess and the steady-state voltage Vcm. When the precharge voltage is released at the time 556, the column voltage (trace 504) begins to drop off fairly rapidly due to the lower impedance of the LED at this elevated voltage. By a time 558 it can be determined that the column voltage is at steady state. Accordingly, the ADC control line (trace 506) is raised to take a sample of the column voltage. Since T(settle) is past, the sample will be kept as a calibration value.

The ADC sample time may be a function of the predicted difference between the start voltage and Vcm. For the first and second calibration cycles shown in FIG. 5, the differences between the start voltage and Vcm are (Vcm−0), and (Vguess−Vcm), respectively. Thus, if (Vguess−Vcm) is expected to be less than (Vcm−0), then the time to the ADC sample may be correspondingly shorter for the second calibration cycle as compared to the first. When the difference between Vguess and Vcm is expected to be small, such as during recalibration, the calibration period may be short.

The time required to achieve steady state need not be calculated in advance of the actual measurement. Instead, while keeping the row (e.g. trace 501) connected to ground and applying the current drive to the column (e.g. trace 503), the processor may request and compare sequential samples of the column voltage to determine when steady state has been reached. The processor may set a measurement time between samples, Tm, to be conveniently short, for example 5 to 100 $\mu$S. Equilibrium may be identified when successive voltage sample values fall within a sufficiently narrow range.

Many techniques may be used to identify achievement of equilibrium by comparing successive samples. For example, sampling may be performed at a constant rate, or at a variable rate. The criteria for identifying the relationship between successive sample values required to establish that equilibrium has been reached may be chosen depending upon system noise, and upon the selected time between samples. A simple determination that successive values differ by less than a threshold may suffice. The threshold may be selected to be a simple numerical figure, as described above. Alternatively, the threshold may depend upon the time interval between measurements. For example, the threshold may be set to a value equal to about 3% of the difference expected (or measured) over the same time interval and drive conditions, when the column voltage begins at 0 volts. A numerical example based on an example described above will clarify this statement. In that example, the column voltage is expected to initially rise by about 63 mV/$\mu$S, so for a 30 $\mu$S interval the voltage would be expected to rise about 1.9 V. Thus, steady state may be deemed to have been reached when the difference between two measurements 30 $\mu$S apart is 3% of 1.9 V, or 57 mV. For a 10 $\mu$S interval, the corresponding threshold would be 19 mV. An exemplary alternative is to require three successive values to all fall within a small range, for example 30 mV. More elaborate systems may filter and smooth the values, particularly so as to discern or predict, in the presence of noise, when the values converge to within a range satisfying the chosen criteria for discerning steady-state.

When the processor deems that T(settle) has been reached after comparing successive measurements, the end of the last sample period (e.g. 554 or 560) may be deemed to end the calibration period. At that time, the calibration row (e.g. trace 501 or 502) may be released from ground and returned to Vdd. The display may be returned to normal operation.

For recalibration, the precharge voltage may be selected to be at, or slightly above, the expected Vcm based on the previous calibration and the present current. This may permit the calibration to be performed within an ordinary scan period.

Timing Diagrams—Normal Operation

Figure 5B:
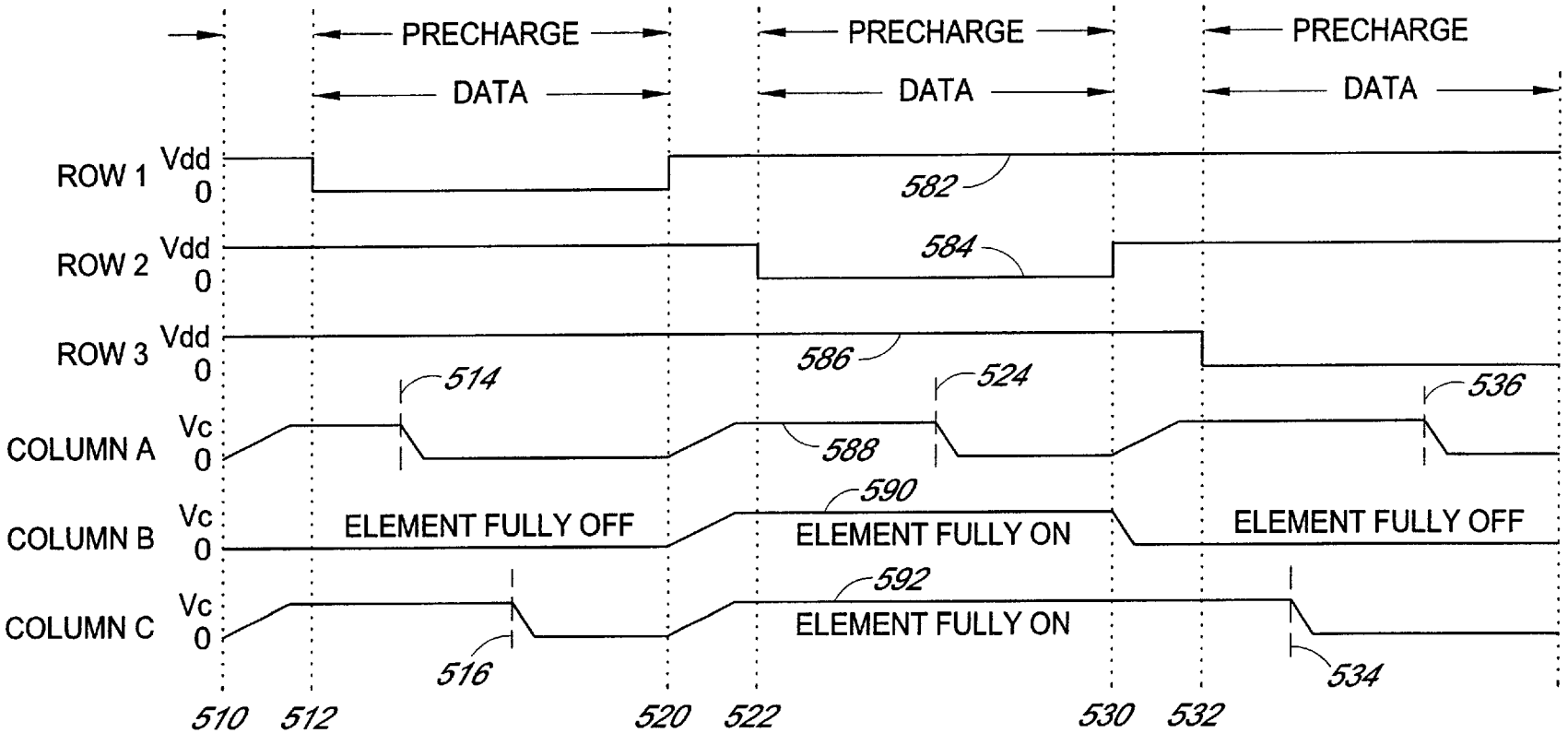
FIG. 5B is a waveform and timing diagram showing normal operation.

FIG. 5B is a representation of the timing and voltages applied or developed during normal operation using a precharge voltage. Voltages are indicated for three representative rows 1–3, shown as traces 582, 584 and 586 respectively, and three representative columns A–C, shown as traces 588, 590 and 592 respectively. Reference numbers between 510 and 550 are provided to indicate particular times within the waveforms. As can be seen, each row (e.g. traces 582, 584, 586) is held at Vdd except during a scan period for the row, when the row is pulled to ground. The first scan period is between times 510 and 520, when Row 1 is pulled to ground; a second scan period is between times 520 and 530, when Row 2 is pulled to ground; and Row 3 is grounded during a third scan period between times 530 and 540.

During the first scan period, Column A and Column C are driven (traces 588 and 592). Column B (trace 590) is not driven. During a precharge period Tpr between time 510 and a time 512 Vpr is provided to rapidly bring the voltage of both Column A and Column C up. By the time 512, the column voltage has essentially reached Vpr, and ideally will be equal to the conduction voltage Vc which will just sustain the selected current through the LED elements. Vc is indicated as the upper value for each of the columns (traces 588, 590 and 592). Vpr may in the non-ideal case vary somewhat from Vc, but no difference is apparent at the scale of these timing waveforms.

At time 512 each column is disconnected from Vpr and connected instead to its current source, as described above. Also, Row 1 (trace 582) is driven to ground, and thus the appropriate voltage is imposed across the elements at the conjunction of Row 1 and the two Columns A and C. The parasitic capacitance of these elements will cause a slight drop of the column voltage due to the change of the row voltage from Vdd to ground, but it is not visible in the column voltages at the present drawing scale. There may also be some slight adjustment of the column voltage while the element is driven by current, which is similarly not visible at the present scale.

At a time 514 the element of Row 1 and Column A is quickly turned off by connecting the column to ground. The column and switch resistances, along with the column parasitic capacitances, will prevent the column from dropping immediately to zero, so a visible slope is seen on the trace 588 following the time 514. It should be noted that it is not necessary to connect the columns to ground per se, and they may instead be connected to any known voltage source which is low enough to ensure that the LED elements are turned off quickly. Meanwhile, the element at the conjunction of Row 1 and Column C continues to be driven until a time 516, when it is similarly connected to ground (or other low voltage) in order to terminate its conductance, and decays to ground rapidly but not instantly.

At the time 520, the second scan period begins with precharge of all three of the represented Columns A, B and C. Precharge ends for this row at a time 522, when Row 2 (the trace 584) is connected to ground and the column drives disconnect each column from the Vpr voltage source and reconnect them to the column current source. All three elements are thus conducting. The element of Row 2 and Column A is terminated at a time 524. However, the other two elements continue to conduct for the maximum time available during the scan, and their termination depends upon the anticipated conduction of the element of the same column but the next row (Row 3).

The trace 590 shows that the element of Column B and Row 3 will be entirely off during the third scan, and accordingly the column is discharged at the end of the second scan period at the time 530, and remains discharged throughout the next scan period. However, the trace 592 shows that the element of Column C and Row 3 will be conducting for at least a portion of the third scan period (until a time 534). In this case, therefore, Column C is not discharged to ground at all, leaving it fully charged so that it does not draw any significant current from the precharge source during the precharge period between the time 530 and a time 532 at the end of the precharge period. Meanwhile, the trace 588 shows an ordinary precharge for the third scan between times 530 and 532, and the trace 586 shows that Row 3 is connected to ground at the time 532 to initiate the exposure period for this third scan. The element of Row 3 and Column A thus conducts until it is terminated at a time 536 by connection of Column A to "zero."

Flow Chart—Calibration Cycle

Figure 6:
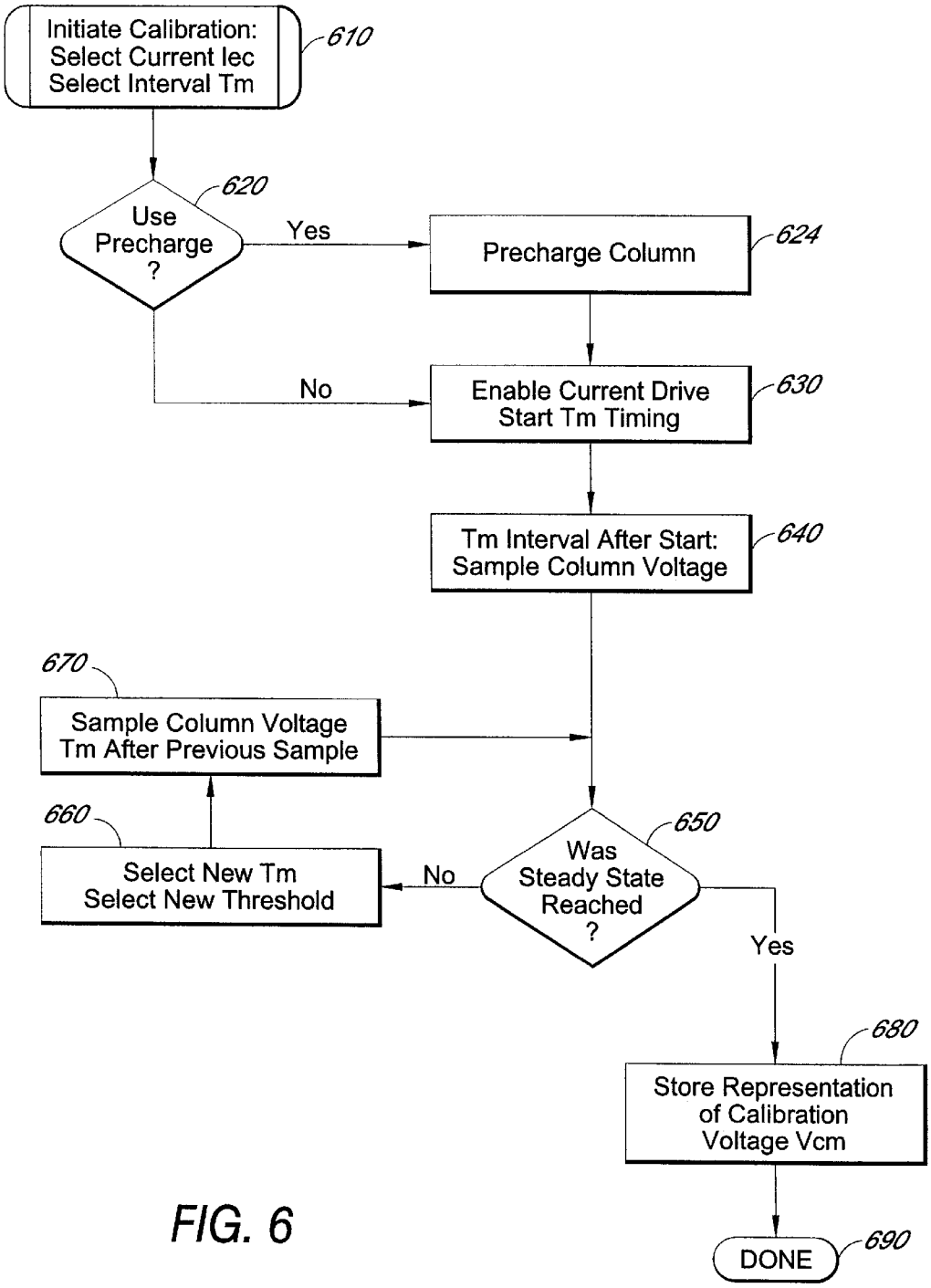
FIG. 6 is a flow chart of driver calibration steps.

FIG. 6 is a flow chart of steps to calibrate a driver so it can accurately precharge a current-driven element to an initial precharge voltage. In particular, in an initialization block 610 an element calibration current Iec is selected and a first measurement interval Tm is chosen. In a decision block 620 a choice is made between calibrating with or without precharge. Considerations for this decision include whether the speed advantage of precharging is needed, and whether a reasonably close precharge value is known. Thus, calibration might be performed without precharge at an initial "power-up" calibration, while precharge might be chosen during a recalibration in order to minimize the time required for the recalibration. Rather than an explicit decision, the system may be programmed in advance to always proceed with precharge, or to always proceed without precharge.

If precharge is chosen, then process control passes to a precharge step 624, at which a value is chosen for the precharge voltage and applied to the column of the element under test. Precharge is generally performed while the row driver connects the row of the element under test to Vdd so that no current flows in the element during precharge, and the selected current Iec is generally not applied; however, as discussed previously, both of these conditions may be varied without changing the substance of the calibration method. The value of the precharge voltage chosen may, for example, be preprogrammed, or calculated on the basis of preprogrammed information. Alternatively, the precharge value may be arrived at from a previous calibration, with or without adjustments. On the basis of characterization stored in memory regarding the element or the type of element, such adjustments may compensate for a different Iec under the previous calibration, or for expected changes in conduction voltage due to the age of the element, or for anticipated driver losses, etc. All of these adjustments may be made under control of a processor which operatively controls the calibration process.

After performing the precharge step 624, or without performing this step if precharge is not selected in decision block 620, the process moves to a timing start step 630 wherein measurement begins of the time period, Tm. Tm is the period during which Iec is driven through the element under test. The row driver of the element under test connects the row of the element under test to ground to permit Iec to flow through the element throughout the period Tm.

After Tm timing has been started, the process moves to a sampling step 640 wherein the column voltage may be sampled at the end of the Tm interval. Then, in a step 650, the column voltage is tested either explicitly or implicitly for achievement of steady state. This step is implicitly satisfied if Tm was initially selected to be long enough to ensure that the column voltage has reached steady state in a single Tm interval. In such event, an explicit step of testing for steady state is not necessary, because the process will always proceed to a step 680 to store the calibration conduction voltage measurement Vcm. If the test of step 650 is not implicitly satisfied, then the value obtained at the step 640 may be compared to the previously known column voltage to determine whether steady state has been achieved. The previous column voltage may have been determined, for example, either as the precharge voltage value, or as the result of a previous measurement. If the comparison between the previously known column voltage and the column voltage just measured satisfies closeness criteria as described previously, then steady state may be deemed to have been achieved. In this event, also, the process moves to the step 680, where the column voltage just measured will be stored as Vcm for calibration purposes. Of course, at step 680 it would also be possible to perform a further column voltage measurement for purposes of averaging or allowing further settling time.

If the test at the decision step 650 yields an explicit negative result, then the process proceeds to a step 660 to select a new Tm if variable intervals between measurement intervals are desired. Particularly if a different Tm is selected at the step 660, different criteria may also be chosen for comparing previous column voltages to determine achievement of steady state may also be selected at this step. However, the previous Tm and threshold criteria may be retained as the new value of Tm. The process proceeds to a subsequent sample step 670, wherein the column voltage is measured again after the new interval Tm has elapsed since the previous sample. Thereafter control will return to the decision step 650, wherein another test is performed for steady state using the criteria selected at the step 660.

Once steady state has been achieved as determined at the state 650, and a representation of the last (or possibly filtered or averaged) value of the column voltage Vcm sample has been stored as a calibration value, the calibration cycle is complete, as indicated at a step 690. The system may then turn to ordinary operation, during which the calibration value Vcm will be used to establish a precharge voltage Vpr on elements before or during element conduction intervals.

Examples of Alternatives and Extensions

One may selectively connect the one or more ADCs successively to a plurality of the elements in a matrix, measuring their voltages at a variety of currents. The FET switches to accomplish such switching are well known in the art. Measurements may also be made while other elements in a row are being driven. This information may be returned to a processing unit, which may deduce different precharge voltages to apply at different times and display conditions. One may connect the one or more ADCs successively to some or all display elements, and the measurements so made may be interpreted by a processing unit as part of a self-test to evaluate the performance of the display and the drivers.

While the above detailed description has shown, described, and pointed out novel features of the invention as applied to various embodiments, the skilled person will be understood that various omissions, substitutions, and changes in the form and details of the device or process illustrated may be made without departing from the scope of the invention. For example, those skilled in the art will understand that the orientation of devices in the display matrix is a matter of design convenience, and the choice of which connections to call rows, and to scan, and which to call columns, is also design convenience. The skilled person will readily be able to adapt the details described herein to a system having different devices, different polarities of devices, and/or different row and column architectures, and can appreciate that such alternative systems are implicitly described by extension from the detailed description below. Calibration may be performed on a plurality of elements either sequentially with a single ADC or simultaneously with a plurality of ADCs. Differences detected between the different device conduction steady-state voltages Vcm may then be used to adjust the value of Vpr for groups of elements. This may be accomplished, for example, by providing a separate DAC for different groups of columns. Vpr variations may be effected by adjusting the value input into the DAC(s), as needed. Variations such as these are contemplated as embodied by the invention. Therefore, the scope of the invention is indicated by the appended claims rather than by the foregoing description. All changes which come within the meaning and range of equivalency of the claims are to be embraced within their scope.

What is claimed is:

1. A method of determining a precharge voltage for current-driven devices in a matrix, the method comprising:

driving a selected current through a target device;

determining a calibration time for a steady-state voltage developed by the target device conducting the selected current, the calibration time being based on a comparison between a plurality of display conduction voltage samples;

sampling a calibration display conduction voltage at the calibration time;

producing a calibration value representing the calibration voltage; and storing the calibration value for later use during normal operation.

2. A method of calibrating a display device having at least one electroluminescent element and a display driver, the method comprising:

(i) predetermining a measurement period of time;

(ii) applying a first current to the element from a current start time;

(iii) continuing the current for the predetermined period of time;

(iv) measuring a display device voltage reflecting a voltage of the electroluminescent element at the end of the predetermined period; and (v) storing a representation of the measured voltage in a memory as a calibration value for later retrieval during a non-calibration mode of the display device.

3. The method of claim 2, further comprising selecting the predetermined period of time to be sufficiently long to ensure that the electroluminescent device voltage reaches equilibrium within a single predetermined period of time.

4. The method of claim 3 comprising selecting the predetermined time to be between about 0.1 millisecond and 10 milliseconds.

5. The method of claim 2, further comprising repeating steps (iii) and (iv) after successive predetermined periods of time within a single calibration cycle until successive measurements satisfy predetermined difference characteristics.

6. The method of claim 5, wherein the predetermined period of time is between 5 microseconds and 200 microseconds.

7. The method of claim 5, wherein step (v) is performed only after the successive measurements satisfy criteria indicating achievement of steady state.

8. The method of claim 5, wherein step (i) includes predetermining a plurality of predetermined periods having different durations.

9. The method of claim 2, wherein applying a first current to the element includes applying a current to at least one column of an OLED array.

10. The method of claim 2, further comprising retrieving the voltage measurement representation during a normal display mode, and precharging a plurality of display element columns at a beginning of a scan to a precharge voltage based upon the retrieved voltage measurement representation.

11. The method of claim 2, further comprising precharging a voltage on the display element prior to starting the first current.

12. The method of claim 2, further comprising executing instructions on a processor to determine the start time and the predetermined period.

13. A calibration circuit for a display device, comprising:

a current source configured to provide a known current to the display device beginning at a calibration current start time;

a measurement circuit configured to sample display device voltages at directed sample times and create representations of the sampled voltages;

a controller configured to select a steady-state sample time corresponding to a steady-state response to the known current, direct the measurement circuit to sample the display device voltage at the steady-state sample time to create a corresponding steady-state voltage representation, coordinate transfer to memory of the steady-state voltage representation, and direct retrieval of the steady-state voltage representation during a non-calibration mode of operation; and a memory configured to store the steady-state voltage representation for retrieval during the non-calibration mode of operation.

14. The calibration circuit of claim 13, wherein the controller is configured to determine the start time, and to select the sample time sufficiently long after the start time to ensure that steady state has been reached by the sample time.

15. The calibration circuit of claim 14, wherein the unit is configured to wait for a period of time after a duration ranging from about 100 microseconds to about 10 milliseconds.

16. The calibration circuit of claim 13, wherein the unit comprises an analog-to-digital converter that is configured to convert the sampled voltage into a digital value for retrieval during the non-calibration mode.

17. The calibration circuit of claim 13, wherein the current source is configured to apply the current to at least one column driver associated with an OLED array.

18. The calibration circuit of claim 13, wherein the controller includes a comparator which compares values of successive column voltage samples.

19. The calibration circuit of claim 18, wherein the controller selects a sample time between 5 and 200 microseconds between successive samples.

20. The calibration circuit of claim 19, wherein the steady-state voltage representation is determined when values of successive samples meet range criteria as determined by the controller.

21. The calibration circuit of claim 13, further comprising a precharge source, wherein the controller includes a precharge value generator which controls the precharge source output during a normal display mode based upon the stored steady-state voltage.

22. The calibration circuit of claim 13, further comprising a precharge source, wherein the controller includes a precharge value generator which directs the precharge source to apply a precharge voltage to the display device during a precharge period.

23. The calibration circuit of claim 22, wherein the start time is preceded by the precharge time.

24. The calibration circuit of claim 23, further comprising a means for precharging a display device element based upon the stored steady-state voltage representation.

25. A calibration circuit for a display device, comprising:

a means for providing a known current to the display device beginning at a calibration current start time;

a means for measuring display device sampled voltages at directed sample times to create representations of the sampled voltages;

a controller configured to select a steady-state sample time corresponding to a steady-state response to the known current, direct the measurement circuit to sample the display device voltage at the steady-state sample time to create a corresponding steady-state voltage representation, coordinate transfer to memory of the steady-state voltage representation, and direct retrieval of the steady-state voltage representation during a non-calibration mode of operation; and a memory configured to store the steady-state voltage representation for retrieval during the non-calibration mode of operation.

* * * * *